United States Patent [19]

Bentley

[11] 3,993,341

[45] Nov. 23, 1976

[54] DECK STRUCTURE AND CONNECTOR FOR BUILDING CONSTRUCTION

[76] Inventor: Charles A. Bentley, 9105 Carmelita Ave., Beverly Hills, Calif. 90210

[22] Filed: Jan. 14, 1975

[21] Appl. No.: 540,827

[52] U.S. Cl. ..... 294/89; 52/125; 52/587; 52/704; 294/96

[51] Int. Cl.[2] ..... B66C 1/54; E04B 1/41; E04C 5/12

[58] Field of Search ..... 294/89, 93, 94, 96; 52/125, 583, 587, 601, 704, 706, 707, 708

[56] References Cited

UNITED STATES PATENTS

| | | | |
|---|---|---|---|
| 1,779,035 | 10/1930 | Dutton | 294/89 |
| 2,719,747 | 10/1955 | Layne | 294/89 |
| 3,067,546 | 12/1962 | Cuperus et al. | 52/704 X |
| 3,505,768 | 4/1970 | Bentley | 52/704 X |
| 3,600,863 | 8/1971 | Nachtsheim | 52/583 |
| 3,652,118 | 3/1972 | Goldberg | 294/89 |
| 3,722,160 | 3/1973 | Bentley | 52/587 X |
| 3,851,428 | 12/1974 | Shuart | 52/587 X |

*Primary Examiner*—Johnny D. Cherry
*Attorney, Agent, or Firm*—Romney Schaap Golant Scillieri Disner & Ashen

[57] ABSTRACT

An improved deck structure and connector for construction of demountable structures such as a parking building as well as permanent structures such as a high rise office or apartment building, comprising connectors spaced along the edges of a concrete slab for attaching the slab to an underlying beam. Each connector includes an upright bushing embedded in the slab for receiving a removable lifting bolt which expands to engage the inside walls of the bushing to lift the slab into location on the beam. The portion of the bushing engaged by the expandable lifting bolt is preferably tapered upwardly between a horizontal mounting plate which rests on top of the beam and an anchor rod extending laterally from the bushing into the slab. The lifting bolt can be released and removed allowing same bushing to receive a fastener bolt. An alternative embodiment provides a downward vertical flange on the connector for welding to an edge of the beam.

12 Claims, 6 Drawing Figures

DECK STRUCTURE AND CONNECTOR FOR BUILDING CONSTRUCTION

The present invention relates in general to deck structures, and more particularly, to an improved deck structure suitable for use in a multi-deck demountable parking building or a permanent multi-story high rise building.

The invention may be incorporated with the deck structure disclosed in my U.S. Pat. No. 3,505,768, issued Apr. 14, 1970, as well as that disclosed in my U.S. Pat. No. 3,722,160, issued Mar. 27, 1973.

It is a primary object of the present invention to provide a deck structure of the foregoing general characteristics wherein concrete slabs can be lifted into position on beams by using removable lifting bolts inserted in the same connector which is later used for demountably or permanently attaching the slabs to the underlying beams. A related object is to provide a removable lifting bolt which engages the connector without the use of internal threads therein.

Another important object of the invention is to provide a strong and stable portion of a vertical bushing in the connector for engaging the expandable lifting bolt. A related object is to provide a connector having a horizontal plate member underneath the slab as well as a lateral anchor embedded in the slab, with both the plate member and the anchor welded to the bushing in close proximity to the portion of the bushing engaging the lifting bolt. Another object is to provide additional stability in the connector with a vertical flange attached to the plate member.

A further object is to provide a connector having a vertical flange extending downwardly from the horizontal plate for abutting an edge of the beam, thereby providing a weldable joint in lieu of or in addition to a fastener bolt inserted through the bushing.

The foregoing objects, advantages, features and results of the present invention, together with various other objects, advantages, features and results thereof which will be evident to those skilled in the art to which the invention relates in the light of this disclosure, may be achieved with the exemplary embodiments of the invention illustrated in the accompanying drawing and described in detail hereinafter.

The invention is adaptable for use in the building structure shown in both my earlier patents identified above, as well as other demountable and permanent multi-deck structures presently known or developed hereafter. However, the structure shown in my later U.S. Pat. No. 3,722,160 constitutes a preferred form and therefore will be used hereinafter as the exemplary product in which to incorporate the improvements of the present invention.

Figure 1:
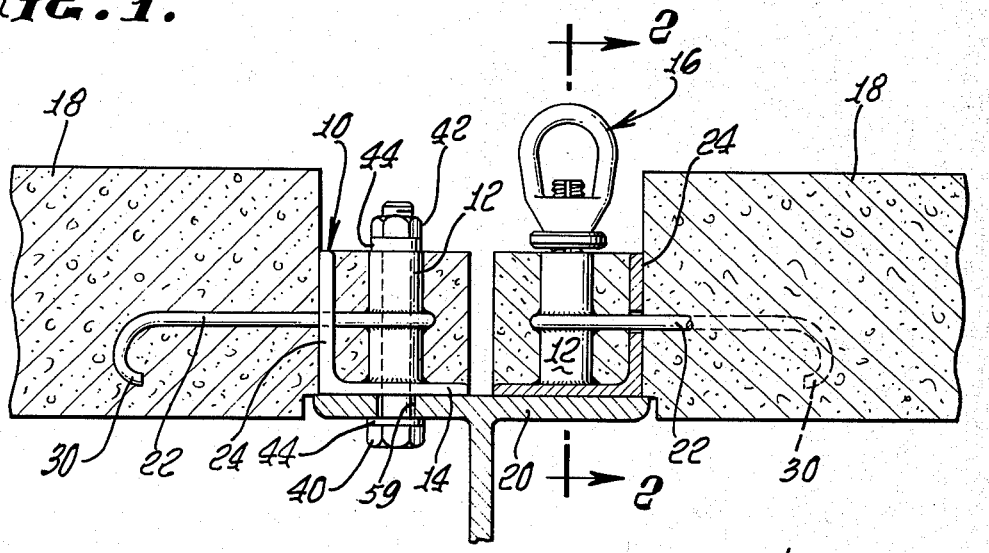
FIG. 1 is a fragmentary sectional view of a presently preferred embodiment of my invention particularly applicable for demountable parking structures.
Figure 3:
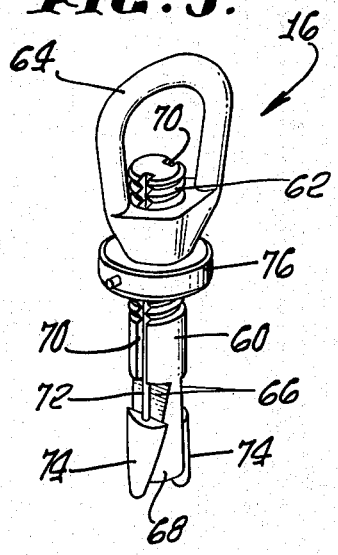
FIG. 3 is a perspective view of the laterally expandable lifting bolt shown in FIGS. 1 and 2.
Figure 2:
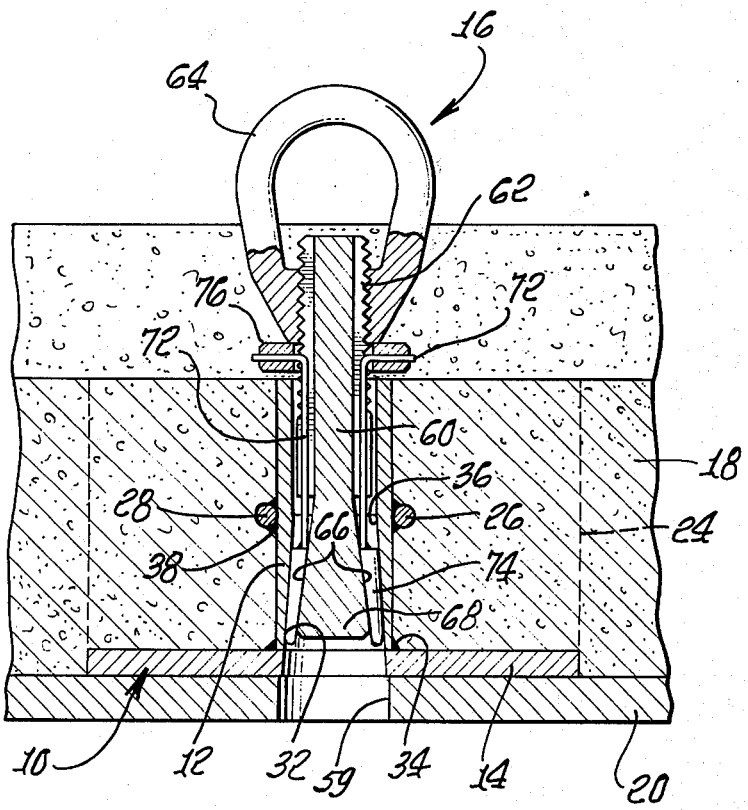
FIG. 2 is an enlarged fragmentary sectional view taken as indicated by the arrowed line 2—2 of FIG. 1.
Figure 4:
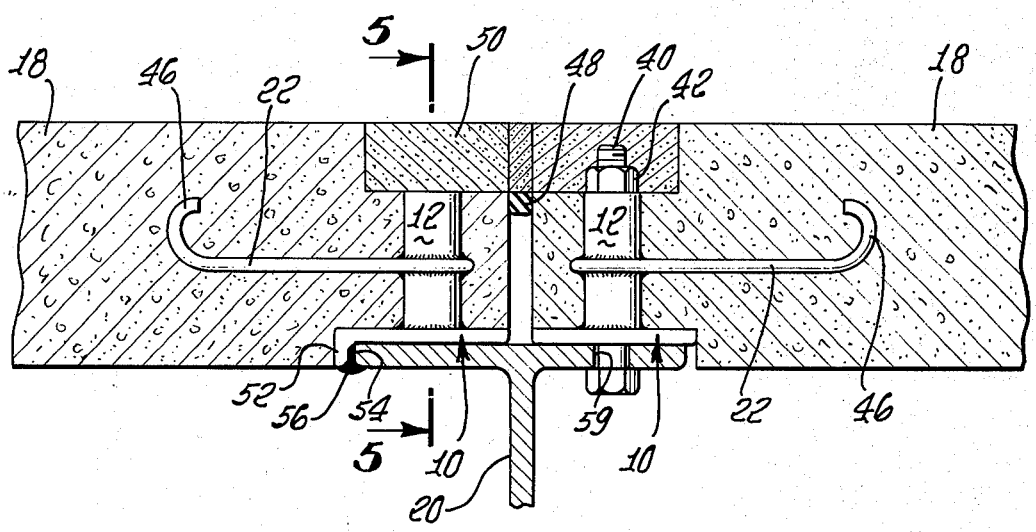
FIG. 4 is a fragmentary sectional view of a presently preferred embodiment of the invention particularly applicable for permanent high rise structures.
Figure 5:
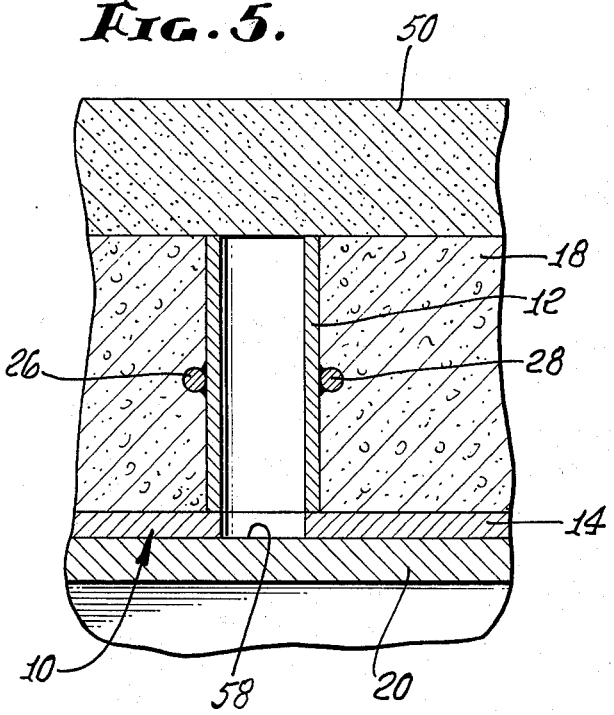
FIG. 5 is an enlarged fragmentary sectional view taken as indicated by the arrowed line 5—5 of FIG. 4.
Figure 6:
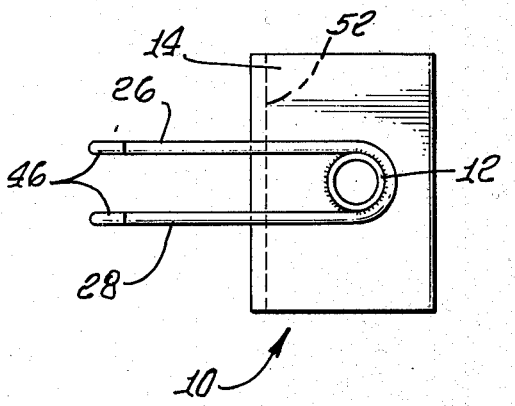
FIG. 6 is top plan view of the connector shown in FIGS. 4 and 5.

Generally speaking, the deck structures in both the embodiment of FIGS. 1–3 as well as the embodiment of FIGS. 4–6 include a connector 10 having a vertical bushing 12 mounted as by welding on a horizontal plate 14 for receiving a lifting bolt 16. When a slab 18 is ready to be lifted into mounting position with the horizontal plate 14 on a beam 20, the lifting bolt 16 is inserted in the top of the bushing to engage a portion of the inner walls of the bushing 12 in the vicinity of the horizontal plate 14. An anchor 22 displaced above the plate 14 and extending laterally from the bushing into the slab 18 provides additional strength and stability. Thus, the stress imparted by the outward flexing of lifting bolt against the bushing wall is dissipated and its effect minimized by the adjacent plate 14 and anchor 22, thereby providing a secure and reliable support link between the lifting bolt 16 and the slab 18. After the slab 18 is in position on the beam 20, the lifting bolt 16 is removed from the bushing 12 so that the same structural features of the connector can be used to securely attach the slab 18 to the beam 20, all without the use of internal threads in the bushing.

Referring now to the connector 10 of the illustrated embodiment shown in FIGS. 1 and 2 particularly suitable for demountable parking structures, the connector may include a vertical flange 24 extending upwardly, from the horizontal plate 14 and embedded in the slab 18. The anchor 22 may take the form of a U-shaped anchor having two legs 26 and 28 which are welded to the outside of the bushing 12 and extend inwardly through the vertical flange 24 so that the free ends of the anchor can be embedded in the slab 18. Typically, additional stability is obtained by spreading the ends of the anchor 22, such as turning each end 30 downwardly on itself, as shown in FIG. 1.

It is preferable to provide an enlarged diameter portion of the bushing 12 to assure a lateral surface component for receiving the upward lifting force transferred from the lifting bolt 16. In the connector embodiment of FIGS. 1 and 2, this wall portion is shown as a cone having its larger-diameter base 32 adjacent the horizontal plate 's junction 34 with the bushing 12 and its smaller-diameter top 36 adjacent the anchor's junction 38 with the bushing 12. Thus, the inside wall of the bushing tapers upwardly between the horizontal plate 14 and the anchor 22.

After the slab 18 has been lifted into mounting location on the beam 20, and the lifting bolt 16 retracted and removed from the bushing 12, the slab 18 and its connector 10 can be demountably attached to the beam 20 by a fastener passing through the same bushing which held the lifting bolt. Typically, a bolt 40 may be inserted through the beam 20, a horizontal plate 14, the bushing 12 and a fastener nut 42. Because the conical taper in the bottom portion of the bushing eliminates supporting contact between the bolt 40 and the inside wall of the bushing 12, secure attachment is facilitated by use of washers 44 or other suitable means.

Referring now to the connector embodiment of FIGS. 4–6 which is particularly suitable for permanent high-rise structures, the exemplary anchor 22 is similar to the one previously described, except that the ends 46 of the legs 26 and 28 embedded in the concrete are bent upwardly and back. The bushing 12 in this connector has a substantially constant diameter throughout its length to allow lateral engagement by the lifting bolt 16 anywhere along the inside walls of the bushing. However, it is preferable to have engagement adjacent lateral support members such as the horizontal plate 14 and the anchor 22. Such constant diameter bushing can be used for conventional attachment of the connector 10 to the beam 20 such as by the bolt and nut 40, 42. A seal strip 48 and filler 50 or other suitable materials may be used to complete the joint between adjacent slabs in the manner already known.

IN some circumstances, it may be desirable to permanently attach the slab 18 and its connector 10 to the beam 20. As shown in FIGS. 4, 5 and 6, a vertical flange 52 may be provided to extend downwardly from the inside edge of the horizontal plate 14 to abut an edge 54 of the beam 20. Th resulting joint may then be welded, as at 56. Such welding joint may be used to supplement a fastener passing through the bushing 12 or such welding joint may serve as the primary fastening means such as when the beam 20 does not have an aperture at 58 in register with the bushing 12.

Where the beam does have a mounting hole 59, alignment with the bushing 12 during the lifting operation may be facilitated by lengthening the lifting bolt 16 to extend below the horizontal plate 14 when the lifting bolt is in locked position inside the bushing.

Although any laterally expandable lifting bolt may be employed in combination with the tapered bushing of FIGS. 1–2, as well as the constant diameter bushing of FIGS. 4–5, the lifting bolt 16 shown in FIG. 3 has been found suitable for each of the connector embodiments previously described. Such a lifting bolt is in the form of an eye bolt having a shaft 60 threaded on its upper end 62 for receiving a head 64, and having opposite upwardly tapered bevels 66 on its lower end 68. An opposing pair of longitudinal slots 70 pass upwardly from the bevels 66 through the threads on the upper end 62 of the shaft 60. A pair of rods 72 lie within the slots 70 and are attached to a pair of dogs 74 at their lower end and a washer 76 on their upper end. The dogs 74 are sized to match the bevels 66 so that when the washer 76 is pushed upwardly to retract the dogs 74 into their corresponding bevels 66, the dogs lie within the outer diameter of the lower end 68 of the shaft 60.

With the washer 76 located below the head 64, the head can be rotated downwardly on the threads to force the washer and therefore the dogs 74 attached thereto downwardly into laterally expanded position on the lower receding portion of the bevels 66. When this is done while the shaft 60 is inserted in the bushing 12, the dogs 74 move into locking position against the side wall of the bushing to provide a lifting connection between lifting bolt 16 and the connector 10 and its attached slab 18. When the slab 18 has been lifted into mounting position on the beam 20, the head 64 can be unthreaded and the washer 76 forced upwardly to retract the dog 74 upwardly to lie within the bevels 66 thereby allowing the lifting bolt to be removed from the bushing 12.

Although exemplary embodiments of the invention have been disclosed for purposes of illustration, it will be understood that various changes, modifications and substitutions may be incorporated in such embodiments without departing from the spirit of the invention as defined by the claims appearing hereinafter.

I claim as my invention:

1. In a deck structure comprising concrete slabs each having connectors spaced apart along the edges of said slab for attachment to an underlying beam, the improvement wherein certain ones of said connectors include:

a horizontal plate adjacent the bottom of said slab;

a vertical bushing attached at a junction with and extending upwardly from said horizontal plate and embedded in said slab and including a downwardly facing contact surface on the inside wall of said bushing adjacent said junction with said horizontal plate for direct coupling to the bottom of said slab;

a lifting bolt removably insertable in said bushing, said lifting bolt including laterally expandable means movable from a retracted unlocked position to an expanded locked position engaging said downwardly facing contact surface for lifting said slab into its mounting location on top of said beam, and actuating means connected to said lifting bolt for locking and unlocking said expandable means.

2. A structure as defined in claim 1 including fastener means insertable in said bushing for securing said slab to said beam after said lifting bolt has been unlocked and removed.

3. A structure as defined in claim 1 including enlarged diameter inside wall means in said bushing adjacent said junction for engagement by said expandable means when it is in said locked position.

4. A structure as defined in claim 3 wherein said enlarged diameter inside wall means of said bushing tapers upwardly to the adjoining inside wall of relatively smaller diameter.

5. A structure as defined in claim 4 including an anchor rod attached to said bushing at a second junction displaced upwardly from said firstmentioned junction with said horizontal plate, and wherein said enlarged diameter inside wall means tapers upwardly between said first and second junctions.

6. A structure as defined in claim 1 including a vertical flange extending downwardly from said horizontal plate and abutting an edge of said beam after said slab is lifted into mounting location on said beam to provide a weldable joint between said connector and said beam.

7. A structure as defined in claim 1 including an anchor extending laterally from said bushing with its free end embedded in said slab.

8. A structure as defined in claim 7 including a vertical flange extending upwardly from said horizontal plate interior of said bushing and embedded in said slab with said anchor extending through said vertical flange.

9. A structure as defined in claim 7 wherein said anchor includes a U-shaped rod embracing said bushing, with the free ends of said rod turned back on themselves.

10. In a deck structure comprising concrete slabs each having connectors spaced apart along the edges of said slab for attachment to an underlying beam, the improvement wherein certain ones of said connectors include:

a horizontal plate adjacent the bottom of said slab;

a vertical bushing attached at a junction with and extending upwardly from said horizontal plate and embedded in said slab;

a vertical flange extending upwardly from said horizontal plate and spaced inwardly from said bushing;

an anchor rod extending laterally from said bushing through said vertical flange and embedded in the interior of said slab;

a lifting bolt removably insertable in said bushing, said lifting bolt including laterally expandable means movable from a retracted unlocked position to an expanded locked position engaging a portion of the inside wall of said bushing which portion comprises a cone-shaped surface tapered upwardly between said horizontal plate and said anchor rod to provide a downwardly facing contact surface displaced from the top of said slab and directly coupled through said horizontal plate and said anchor rod to the bottom and interior of said slab, respectively; and actuating means connected to said lifting bolt for locking and unlocking said expandable means.

11. In a deck structure comprising concrete slabs each having connectors spaced apart along the edges of said slab for attachment to an underlying beam, the improvement wherein certain ones of said connectors include:

a horizontal plate adjacent the bottom of said slab;

a vertical bushing attached at a junction with and extending upwardly from said horizontal plate and embedded in said slab;

an anchor rod extending laterally from said bushing and embedded in said slab;

a lifting bolt removably insertable in said bushing, said lifting bolt including laterally expandable means movable from a retracted unlocked position to an expanded locked position engaging a portion of the inside wall of said bushing which portion comprises a contact surface tapered upwardly between said horizontal plate and said anchor rod and displaced from the top of said slab to directly couple said lifting bolt through said horizontal plate and said anchor rod to the bottom and interior of said slab, respectively; and actuating means connected to said lifting bolt for locking and unlocking said expandable means.

12. A structure as defined in claim 11 including a vertical flange extending downwardly from said horizontal plate for abutting an edge of said beam.

* * * * *